US008123093B2

(12) United States Patent
Merzon

(10) Patent No.: US 8,123,093 B2
(45) Date of Patent: Feb. 28, 2012

(54) BOOK SLING

(76) Inventor: Adam Merzon, Greenwich, CT (US)

( * ) Notice: Subject to any disclaimer, the term of this patent is extended or adjusted under 35 U.S.C. 154(b) by 406 days.

(21) Appl. No.: 11/755,504

(22) Filed: May 30, 2007

(65) Prior Publication Data

US 2008/0030015 A1 Feb. 7, 2008

Related U.S. Application Data

(60) Provisional application No. 60/803,503, filed on May 30, 2006, provisional application No. 60/849,407, filed on Oct. 4, 2006.

(51) Int. Cl.
*A45F 3/02* (2006.01)
*A45F 3/04* (2006.01)

(52) U.S. Cl. ..... 224/645; 224/250; 224/259; 224/614

(58) Field of Classification Search ..... 224/645, 224/259, 628, 625, 250, 601, 604, 614; 294/149, 294/150, 152, 157, 164; 150/110; 281/45; 383/72, 74, 76, 79
See application file for complete search history.

(56) References Cited

U.S. PATENT DOCUMENTS

| | | | | | |
|---|---|---|---|---|---|
| 554,574 | A * | 2/1896 | Bennet | 206/425 |
| 1,082,017 | A * | 12/1913 | Feinen | 294/149 |
| 1,663,708 | A * | 3/1928 | Keeler | 294/149 |
| 2,107,880 | A * | 2/1938 | Wilsdorf | 297/380 |
| 3,825,298 | A * | 7/1974 | Chipman | 297/129 |
| 4,887,752 | A * | 12/1989 | Nauta | 224/621 |
| 4,988,216 | A * | 1/1991 | Lyman | 383/74 |
| 5,114,059 | A * | 5/1992 | Thatcher | 224/148.5 |
| 5,238,162 | A * | 8/1993 | LaCivita | 224/250 |
| 5,251,945 | A * | 10/1993 | Stoops | 294/152 |
| 5,785,427 | A * | 7/1998 | Godshaw | 383/4 |
| 5,797,491 | A * | 8/1998 | Fierek et al. | 206/373 |
| 5,893,504 | A * | 4/1999 | Baronian et al. | 224/656 |
| 6,179,187 | B1 * | 1/2001 | Lemire et al. | 224/640 |
| 6,347,730 | B1 * | 2/2002 | Frederick | 224/259 |
| 6,655,564 | B1 * | 12/2003 | Zupan | 224/628 |
| 6,672,439 | B2 * | 1/2004 | Platte, III | 190/103 |
| 6,712,250 | B2 * | 3/2004 | Vigny | 224/640 |
| 6,749,095 | B2 * | 6/2004 | Johnson | 224/250 |
| 6,889,407 | B2 * | 5/2005 | Martin | 24/136 R |
| 7,303,102 | B2 * | 12/2007 | Werts | 224/607 |
| 2005/0133560 | A1 * | 6/2005 | Taylor | 224/630 |

* cited by examiner

*Primary Examiner* — Justin Larson
*Assistant Examiner* — Steven M Landolfi, Jr.
(74) *Attorney, Agent, or Firm* — Stephen Cannavale, Esq.

(57) ABSTRACT

A book sling of a generally U-shaped sling cradle is provided with first and second side walls, and a bottom disposed between the side walls upon which one or more books received in the cradle of the book sling rest. Advantageously, the book sling has open sides and an open top enabling quick visual determination of which particular book should be taken out during use, thereby making it quicker and easier to use than a backpack that completely encloses everything such that it cannot be viewed without first opening the backpack.

11 Claims, 13 Drawing Sheets

BOOK SLING

CROSS-REFERENCES TO RELATED APPLICATIONS

This application claims the benefit of U.S. Provisional Application No. 60/803,503, filed May 30, 2006, and U.S. Provisional Application No. 60/849,407, filed Oct. 4, 2006, the entire contents of which are incorporated by reference herewith.

FIELD OF THE INVENTION

The present invention relates to a shoulder-carried book holder and, more particularly, to a book sling for securely carrying objects.

BACKGROUND OF THE INVENTION

The popularity of backpacks has increased in recent years. They are widely used for day hiking, bicycling, and climbing as well as for carrying books and supplies by students.

As the national emphasis continues to be placed on improving the design of a book container or carrying bags, there is a need for a container which can be opened and closed more efficiently and which can hold the objects more firmly.

Moreover, there is a need for a book container that can provide immediate visual feedback of inner contents without the need to open up the container itself.

SUMMARY OF THE INVENTION

The current invention provides for a book sling of a generally U-shaped sling cradle formed of first and second side walls, and a bottom disposed between the side walls upon which one or more books received in the cradle of the book sling rest. Advantageously, the book sling has open sides and an open top enabling quick visual determination of which particular book should be taken out during use, thereby making it quicker and easier to use than a backpack that completely encloses everything such that it cannot be viewed without first opening the backpack.

These and other advantages of this invention will become apparent from the following detailed description, which, taken in conjunction with the annexed drawings, discloses the preferred embodiment of the invention.

BRIEF DESCRIPTION OF THE DRAWINGS

The invention will be more fully understood from the following detailed description taken in conjunction with the accompanying drawings which form a part of this application, wherein like numerals referred to like parts and in which.

DETAILED DESCRIPTION OF THE PREFERRED EMBODIMENT

Figure 1:
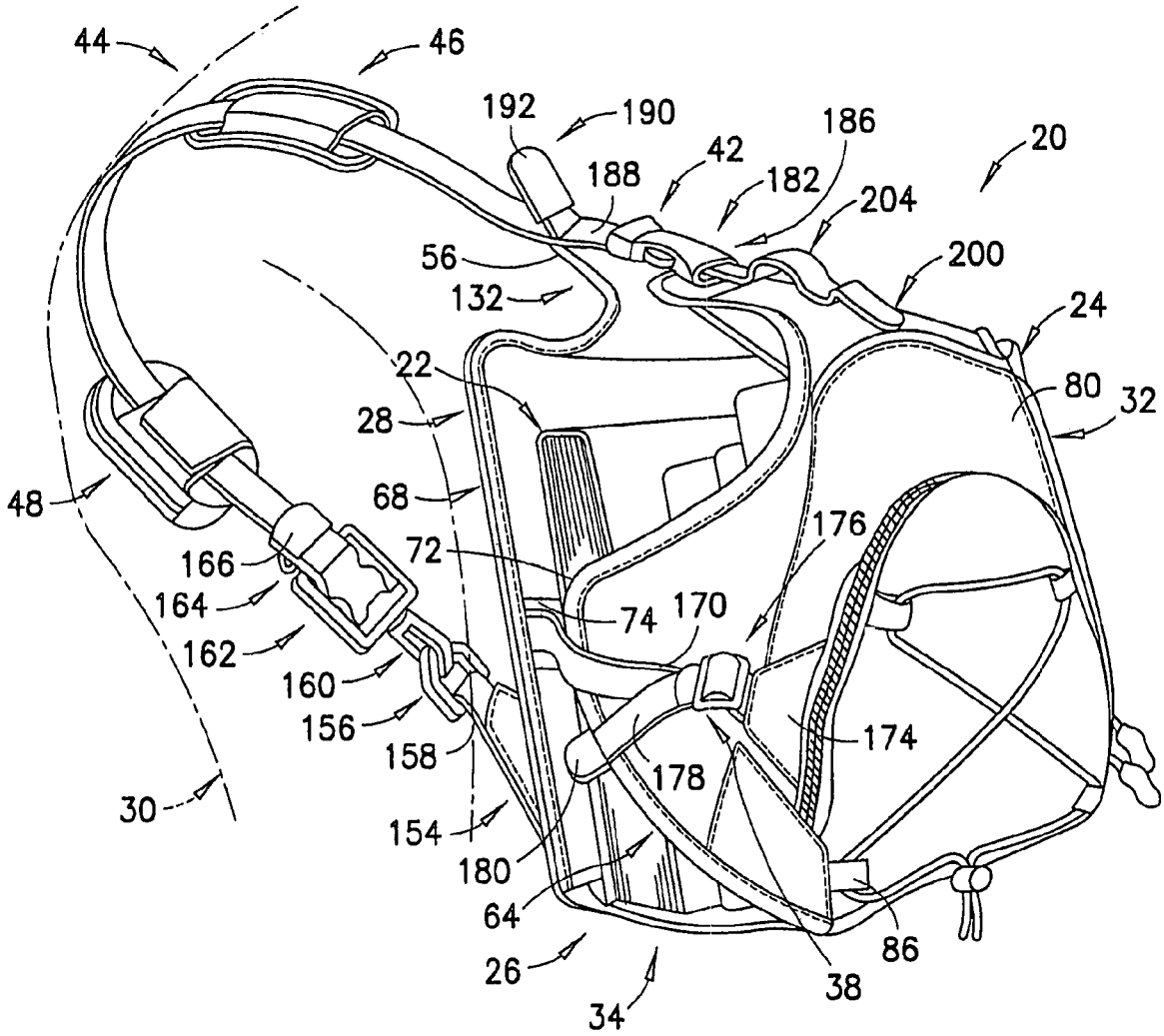
FIG. 1 is a perspective view of a book sling constructed in accordance with the present invention carrying a plurality of books depicting the book sling in a shoulder carried or operational position.

FIGS. 1-4 illustrate a book sling 20 constructed in accordance with the invention that is of open side construction advantageously permitting quick, easy and convenient loading and unloading of at least one of a plurality of books 22 capable of being removably carried by the sling 20. The book sling 20 quickly and easily adjusts to conform to the number, shape and orientation of the books 22 loaded into it, facilitating easy and stable lifting onto the back or shoulder of a person wearing the book sling 20. Such an adjustably conformable construction advantageously provides excellent comfort when worn while making it quick and easy to put on, take off, load and unload during use and operation of a book sling configured in accordance with the present invention.

The book sling 20 includes a body 24 made preferably of a flexible webbing 26 configured to provide a front wall 28 that lies against the backside of a person 30 (in phantom in FIG. 1) wearing the sling 20 and a rear wall 32 spaced from the front wall 28 by a bottom 34 arranged to form a generally U-shaped cradle 36 in which the books 22 are placed to transport them. The flexible webbing 26 is preferably composed of a flexible material, such as a flexible fabric, a flexible woven material, a flexible non-woven material, or another suitable flexible material. Examples of suitable commercially available materials include nylon, vinyl, GORE-TEX, and leather.

In a preferred embodiment, a plurality of pieces are joined, such as by stitching, bonding, riveting or the like to form the webbing 26. In another preferred embodiment, the webbing 26 is made of a single piece of flexible material such that the front wall 28, the rear wall 32 and the bottom 34 are also made from the same single piece of material.

The sides between the front wall 28 and the rear wall 32 are generally open. Preferably, adjustable side restraints 38 and 40 extend along each side of the cradle 36 and between the sling walls 28 and 32 keeping books 22 in the cradle 36 while also enabling wall spacing adjustment, which advantageously permits the book-carrying capacity of the sling 20 to be correspondingly varied as needed. More preferably, a top restraint 42 overlies at least a portion of the cradle 36 and extends between the sling walls 28 and 32. Preferably, the top restraint 42 is adjustable and reclosable, permitting convenient and efficient loading or unloading of the books 22.

The top restraint 42 attaches preferably to the front sling wall 28 adjacent where one end of a flexible and adjustable shoulder strap 44 is attached. As is depicted in the preferred embodiment of FIG. 1, the strap 44 goes over and around the backside of the shoulder and part of the back of a person 30 (shown in phantom in FIG. 1) wearing the sling 20. The strap 44 carries a position-adjustable, comfort-enhancing shoulder pad 46 and a reclosable pouch 48 preferably configured as an electronic device storage that is also capable of being moved along the strap 44. The pouch 48 preferably is also configured so it can be removed and reattached to the strap 44 in a quick and easy manner enabling the person 30 to take the pouch 48 with them independent of where they leave the sling 20.

Figure 2:
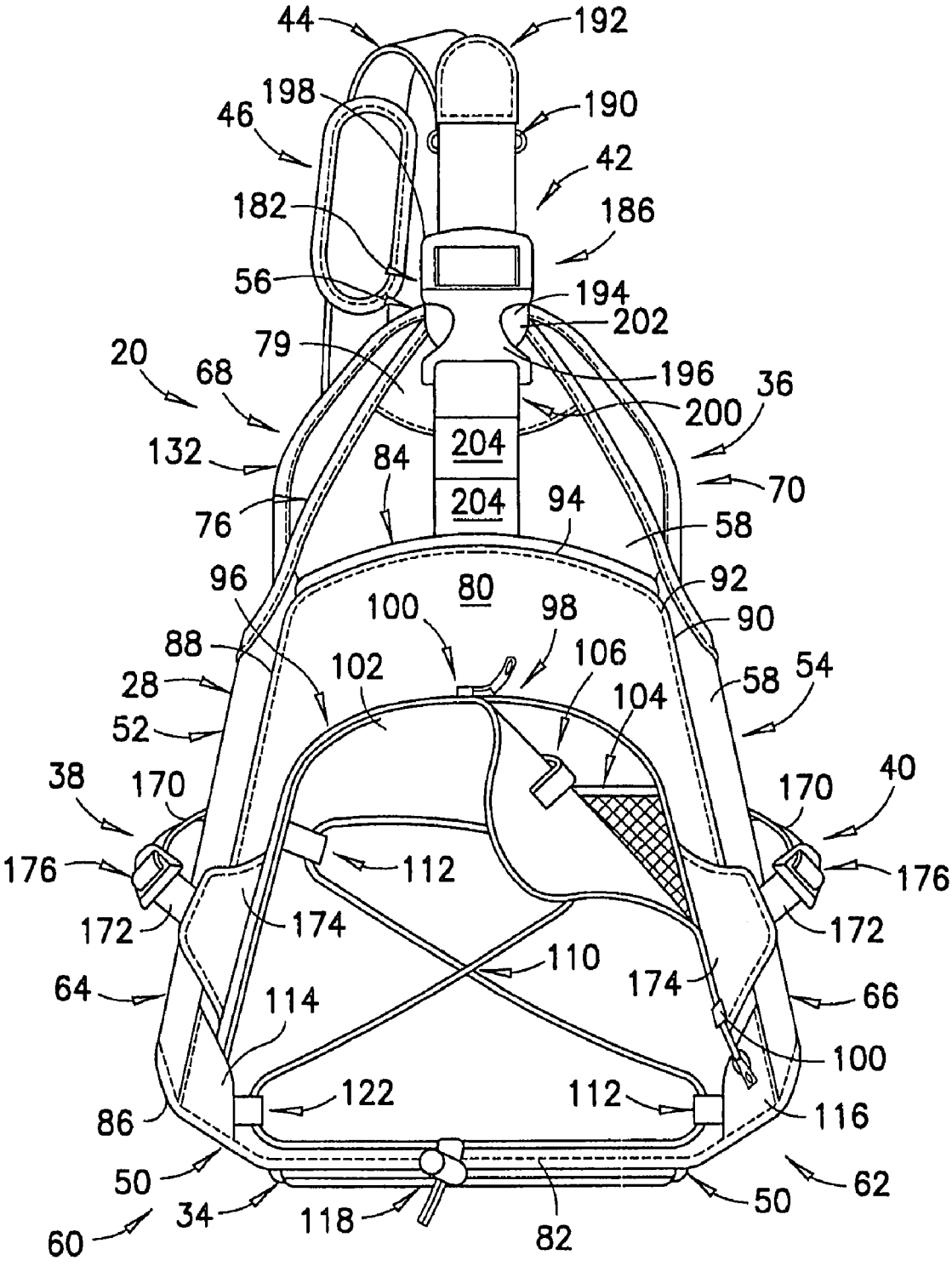
FIG. 2 is a front elevation view of the book sling according to FIG. 1.

FIG. 2 illustrates the rear sling wall 32 of the preferred embodiment in more detail. The rear wall 32 is preferably of elongate construction having a bottom edge 50, a pair of sides 52 and 54 and a top edge 56 defining a rear wall panel 58. The rear wall panel 58 is made of a flexible material, such as a fabric, a cloth, a woven material, a non-woven material or the like. Examples of suitable flexible wall materials include nylon, vinyl, GORE-TEX, or leather.

In the preferred embodiment depicted in FIG. 2, the wall panel 58 may be of any configuration, but preferably is of a generally trapezoidal construction, preferably having its base angle at each bottom corner 60 and 62 of the panel 58 being substantially the same such that they are within about 5° of one another. In the preferred embodiment of the wall panel 58 depicted in FIG. 2, the bottom left corner angle is defined as an angle formed by an intersection between an imaginary line running substantially coincident with and generally parallel to the left side 52 and the bottom 50 and the bottom right corner angle is defined as an angle formed by an intersection between a line substantially coincident with the right side 54 and the bottom 50.

In combination with the side restraints 38 and 40, the aforementioned wall panel shape of the preferred embodiment advantageously helps encourage books 22 received in the sling 20 to self-center themselves, including while the sling 20 is being carried by a person 30 who is walking. This advantageously helps increase load stability by preventing load shifting during use and operation. For example, while being carried by a walking person, the resultant up and down motion imparted on the sling 20 in combination with the force of gravity acting on the books 22 in the sling 20 can cause book movement helping self-center each book 22 relative to the center of the sling bottom 34.

The top edge 56 can deviate from being generally straight, as one would ordinarily expect it to be where the wall panel 58 is of trapezoidal construction, such that it is generally triangular, curved, and/or includes an apex at its very highest point as a result of convergence between the panel sides 52 and 54, such as is depicted in FIG. 2. As is shown in FIG. 2, panel sides 52 and 54 preferably converge by being angled toward one another. In the preferred embodiment of FIG. 2, the apex produced from this panel side edge convergence is obstructed by part of the top restraint 42.

Preferably, the rear wall 32 includes at least one or a pair of book retaining side flaps 64 and 66, which extend outwardly from corresponding panel side edges 52 and 54 to help keep books 22 from falling out of the sling 20, particularly when a person 30 is carrying the sling 20 on their shoulder. One or more side flaps 64 and 66 may be formed to extend from the front wall 28.

In a preferred arrangement, each one of the side flaps 64 and 66 cooperates with a corresponding side restraint 38 and 40 to help prevent the books 22 in the sling 20 from falling out of a respective open side 68 and 70 of the sling 20. In doing so, each side flap 64 and 66 constrains side-to-side movement of the books 22 received in the sling cradle 36. The side flaps 64 and 66 preferably cooperate with the side restraints 38 and 40 such that the restraints 38 and 40 overlie parts of the respective flaps 64 and 66 along a lengthwise extending section of the flap, preferably along its maximum lengthwise extent.

In the preferred side flap embodiment shown in FIGS. 1-4, each side flap 64 and 66 is generally triangular with part of the flap underlying its corresponding restraint 38 or 40 such that at least part of the flap adjacent its apex 72 (FIG. 1) underlies at least a portion of the restraint. In the preferred flap embodiment shown in FIG. 15 each flap 64 and 66 is connected to the front wall 28. Where connected to the front wall 28, each flap 64 and 66 preferably is connected by a fixed length of belt or strap 74. As is also shown in FIG. 1, the flap connector strap 74 preferably connects to the front wall 28 adjacent where corresponding side restraint 38 connects to the front wall 28. Where the front wall connection of these two sling components is adjacent each other, the strap 74 preferably underlies part of corresponding side restraint 38.

Figure 4:
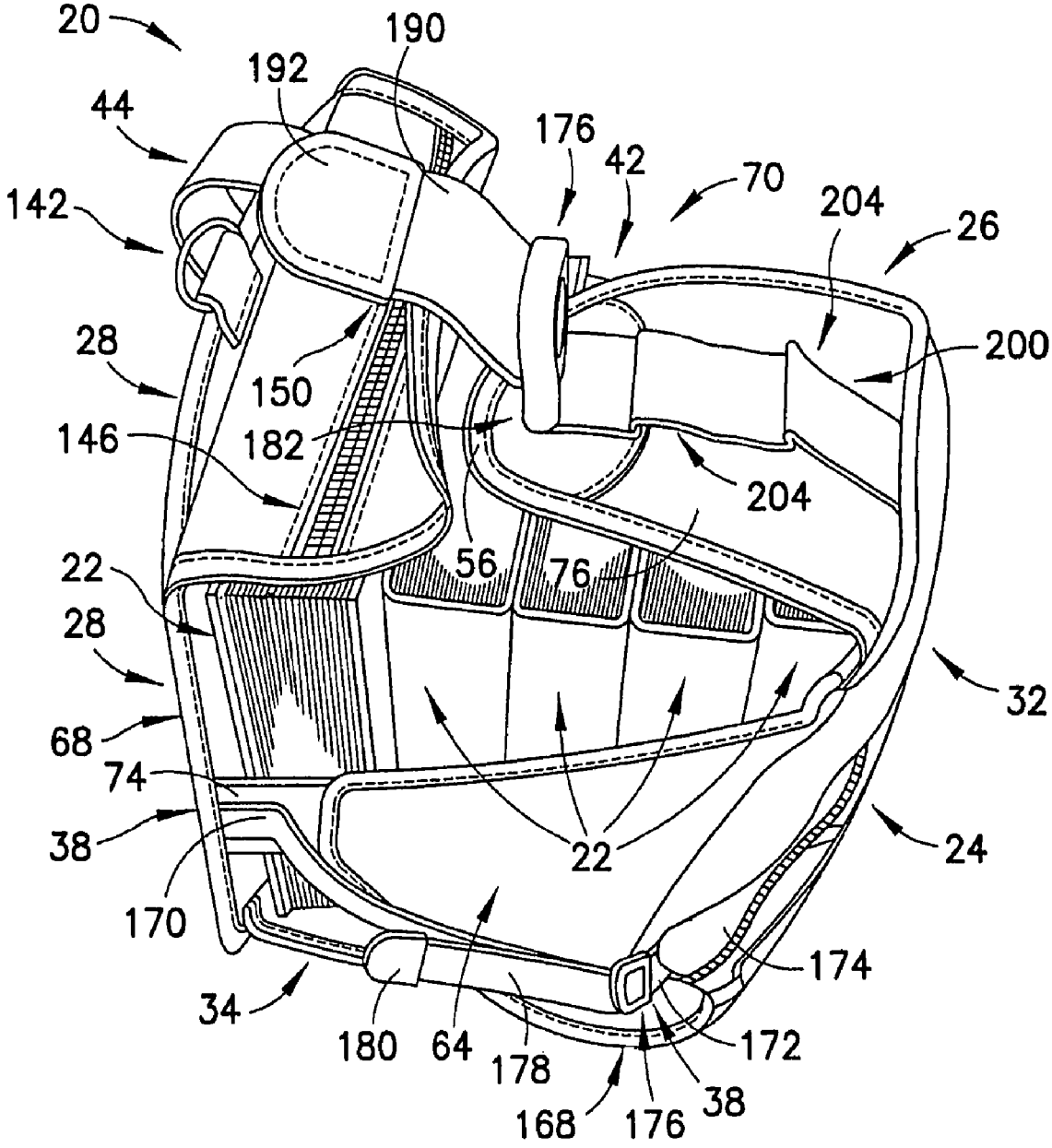
FIG. 4 a perspective view of the book sling taken from above and to one side of the book sling.

The rear wall 32 preferably also includes a top cover flap 76 that extends upwardly towards a top part of the front wall 28, such as in the manner shown in FIGS. 1 and 4. The cover flap 76 also is generally triangular with one end of the top restraint 42 preferably being attached to it at or adjacent its apex 56. A gusset 79 may be fixed to the cover flap 76 and to part of the top restraint 42 to securely anchor the restraint 42 to the rear wall 32.

In the preferred embodiment shown in FIGS. 1-4, the top restraint 42 is fixed to the cover flap 76 adjacent apex 56 but spaced a distance from its outer or top edge leaving a lip 78 that can overlap with the top part of the front wall 28, if desired. For example, where the top restraint 42 is length adjustable, the cover flap lip 78 can overlap with part of the top part of the front wall 28 when the length of the top restraint 42 is sufficiently shortened. This can help optimize the ability of the book sling 20 to be expanded or contracted as needed to vary its storage capacity to accommodate the particular volume of books 22 being carried at the time.

The rear wall 32 can include an overlay 80 made a panel of flexible material that preferably is the same as or like the material of the rear wall 32. The overlay panel 80 preferably has a shape substantially complementary to that of at least a portion of the rear wall 32. For example, as is best shown in FIGS. 1 and 2, the overlay panel 80 preferably has a quadrilateral shape that can also be of generally trapezoidal construction.

No matter what its shape, the overlay panel 80 preferably may have a bottom edge 82 that is adjacent and which can be substantially coincident with the bottom edge 50 of the rear wall 32. The bottom edge 82 preferably is longer than the overlay panel top edge 84, which can be curved as shown in FIG. 2. For example, the bottom edge 82 of the overlay panel 80 preferably is fixed to the rear wall 32 via an elongate stitched seam 86 that extends along the bottom 34 of the rear wall 32. Where the rear wall 32 has tapering or converging sides 52 and 54, the overlay panel 80 can also have same or similar converging side edges 88 and 90. For example, as is shown in FIG. 2, each overlay panel side edge 88 and 90 preferably is generally parallel to a corresponding rear wall side 52 and 54.

The overlay panel 80 can be configured as an open top pocket capable of receiving objects, preferably flat in shape, inserted into the pocket along the top edge. In one preferred embodiment, stitching 92 extends along both panel side edges 88 and 90, fixing the panel 80 along its side edges 88 and 90 to the rear wall 32. A seam 94 preferably extends along the curved top edge 84 of the panel 80 in the manner illustrated in FIG. 2. Where it is desired to attach the panel 80 to the rear wall 32 along the top edge 84, the stitching 92 along the side edges can also be extended along the panel top edge 84.

The rear wall 32 can also carry a reclosable compartment 96, such as is depicted in FIG. 2 on either or both sides of the rear wall 32. The compartment 96 may preferably include an elongate reclosable fastener arrangement 98 that defines a mouth or opening through which articles (not shown) can be inserted into the compartment 96. The fastener arrangement 98 preferably is a zipper 100 that extends along part of the periphery of an outer compartment wall panel 102. In the preferred embodiment, the zipper 100 extends along a top edge and at least a portion of both side edges of the outer wall panel 102. If desired, the zipper 100 can be further configured to attach the outer panel 102 to the overlay panel 80 and/or the rear wall 32.

In the preferred compartment embodiment shown in FIG. 2, a mesh article retaining pocket 104 can be provided inside the compartment. The compartment 96 can also include one or more pen or pencil holding loops 106, which can be attached to the inner surface of the outer panel 102.

An article tie down arrangement 108 can be carried by the compartment 96, preferably mounted to or otherwise defined in part by outer wall panel 102. The tie down arrangement 108 may preferably include an elastic hold down cord 110, e.g., bungee cord, arranged in a criss-cross manner, as is shown in FIG. 2, by threading the cord 110 appropriately through four guide loop tabs 112 spaced about the periphery of the outer panel 102. While all of the tabs 112 can be anchored to the outer panel 102, the tabs 112 are each preferably attached to a respective one of a plurality of corner gussets 114 and 116 located at or along each bottom compartment corner. The ends of the cord 110 are preferably held captive in a thumb operated slide cinch adjuster 118 that enables cord tension adjustment. This can advantageously enable the cord 110 to be loosened or tightened as needed to hold an article (not shown) manually placed between the cord 110 and the outer surface of the outer compartment wall panel 102.

The corner gussets 114 and 116 preferably also help reinforce the corresponding bottom corner 60 and 62 of the rear wall 32, such as is depicted in FIG. 2. Each gusset 114 and 116 preferably helps stress risers from concentrating at corresponding rear wall bottom corners 60 and 62 when the book sling 20 is carrying a heavy load. Each gusset 114 and 116 may help prevent this from happening by spreading out forces from the load along the portions of the real wall bottom and side edge extending adjacent where the gusset is attached. This can advantageously help enable a book sling 20 constructed in accordance with the invention to lack any kind of rigid or substantially rigid framework or support structure and permit its walls 28, 32 and 34 and flaps 64, 66 and 76 to be made of a flexible material, such as the flexible materials disclosed above.

Figure 3:
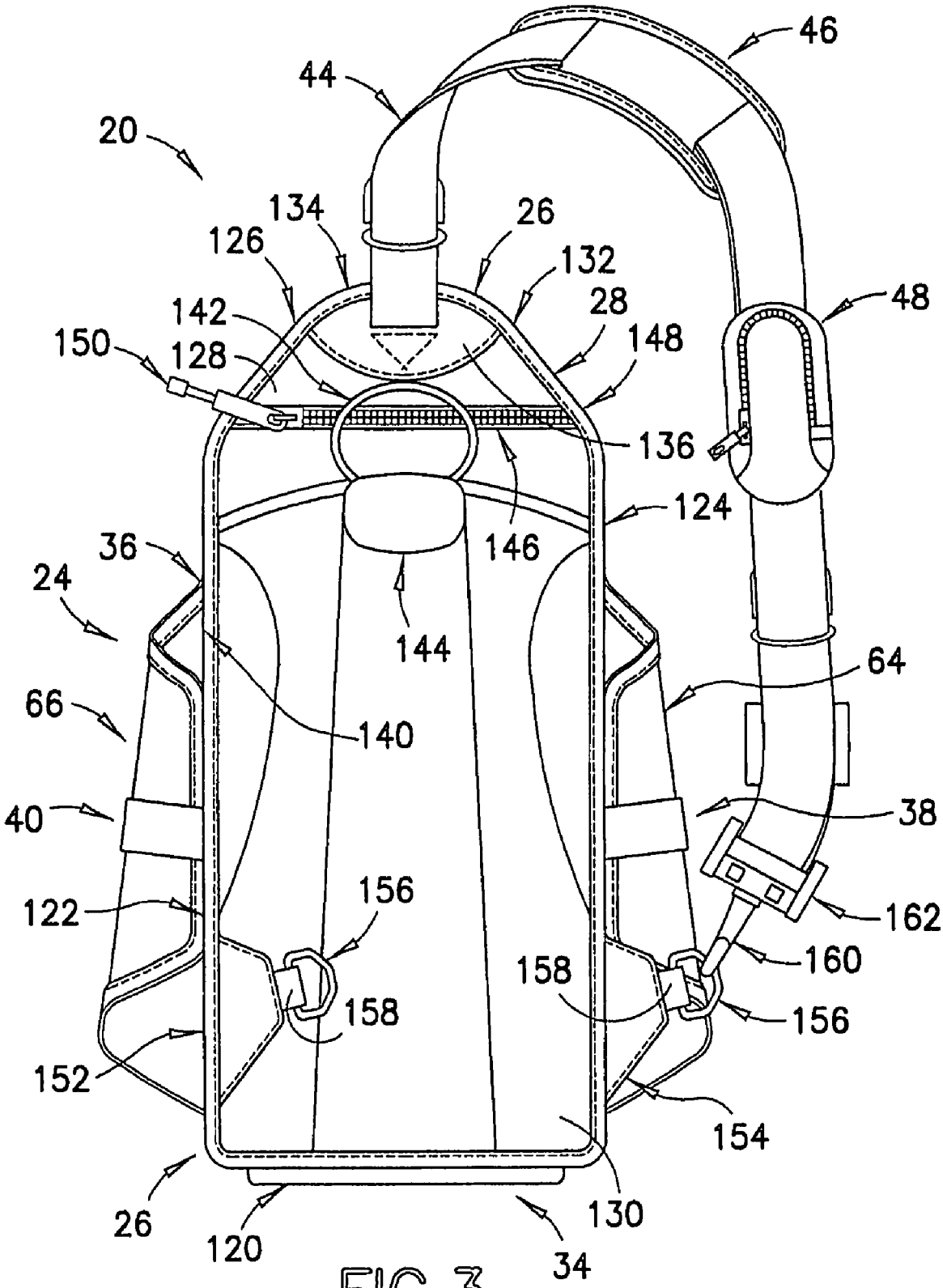
FIG. 3 is a rear elevation view of the book sling according to FIG. 1.

FIG. 3 illustrates the front sling wall 28 of the preferred embodiment in more detail. The front wall 28 also is preferably of elongate construction having a bottom edge 120, a pair of sides 122 and 124 and a top edge 126 defining a front wall panel 128 of generally quadrilateral construction. In the preferred wall panel embodiment show in FIG. 3, the front wall panel 128 preferably is substantially rectangular. The wall panel 128 preferably is also made of a flexible material, such as a fabric, a cloth, a woven material, a non-woven material or the like.

The front wall 28 preferably includes an outer surface 130 that faces toward and typically bears against the back of a person 30 carrying the book sling 20. The front wall 28 preferably includes a generally top cover flap 132 that preferably also is generally triangular like the rear wall cover flap 76.

Likewise, the other end of the top restraint 42 is attached to the cover flap 132, preferably adjacent its apex 134. A reinforcement gusset 136 preferably is provided to more securely anchor the top restraint 42 to the front wall 28 helping reinforce where it attaches.

The front wall 28 can also include an outer overlay panel 138 that is elongate and which preferably is fixed substantially about its periphery to the front wall panel 128. In the preferred embodiment shown in FIG. 3, a seam 140 extends about its entire periphery with stitching preferably used in attaching the overlay panel 138 to the wall panel 128. The overlay panel 138 preferably sandwiches comfort-increasing padding (net shown) between it and wall panel 128.

To enable the book sling 20 to be hung up, such as on a wall mounted hook or peg (not shown), the front wall 28 can be equipped with a hanger loop 142 that is anchored by a gusset 144 to the front wall 28. In the preferred embodiment shown, the gusset 144 is generally centrally located, disposed so it overlaps a top portion of the overlay panel 138 and seam 140, and can have a portion folded underneath the overlay panel 138. The hanger loop 142 is preferably attached to the gusset 144 at or adjacent each loop end.

Located adjacent and preferably above the hanger loop gusset 144 is a transversely extending reclosable opening 146 of an article holding pocket or compartment disposed on either or both sides of the front wall 28. It may preferably include a reclosable fastening arrangement 148 that preferably is a zipper 150 or the like that can be opened to enable compartment access and that can be closed to prevent compartment access.

In one preferred embodiment, the integral wall formed compartment holds a rain shield (not shown) made of a water-resistant or water impervious material such as plastic, e.g., plastic film, or the like, which is packed in the compartment during book sling manufacturing.

Such a rain shield can be configured to serve as a hood that can be pulled at least partially out of the compartment in the wall 28 when the zipper 150 is open, manually rearranged, such as by unfolding it and/or spreading it out, and placed relative to the exposed parts along the top and sides of the book sling 20 so as to keep the rain away from any books 22 being carried by the book sling 20. In one preferred rain hood configuration (not shown), the hood is made of a plastic film or thin sheet material that can be unfolded and arranged so it overlies, not just the book sling 20, but the person 30 wearing the book sling 20 as well.

Located adjacent and above the front wall bottom 120 preferably are a pair of generally triangular shoulder strap mounting ears 152 and 154 enabling the shoulder strap 44 to be attached so the book sling 20 can be worn over either shoulder. Each shoulder strap mounting ear 152 and 154 preferably includes a D-ring 156 carried by a loop 158 that is fixed to the respective ear.

The shoulder strap 44 preferably has a manually operated snap 160 that releasably engages the D-rings 156 of one of the mounting ears 152 or 154, depending on user preference, e.g. comfort, left-handed, etc. The shoulder strap 44 preferably includes a strap adjuster 162 for enabling shoulder strap length to be changed by the user 30. One preferred type of adjuster 162 suitable for use is a tape adjuster, or the like, that is configured to function or operate the same as or similar to that of a slide adjuster.

As is shown in FIG. 1, the shoulder strap 44 preferably is threaded through the adjuster 162 such that a handle strap segment 164 extends outwardly from the adjuster 162 toward a user 30 wearing the book sling 20 permitting it to be grasped and manipulated, e.g., pulled, to adjust strap length while the sling 20 is being worn. Capping the free end of the handle strap segment 164 preferably is selvage, welting or the like forming a grasp tab 166 that can be felt by touch, grasped and pulled while the book sling 20 is being worn. Because of its unique size, shape, texture, etc., it can advantageously enable a person 30 to more easily blindly find the strap segment 164 by feel when reaching back while wearing the book sling 20. Such a grasp tab 166 may also help prevent the handle strap segment 164 from being inadvertently pulled completely free of the cinching strap adjuster 162. While the strap 44 can be constructed without such a grasp tab 166, it preferably is equipped with such a grasp tab 166 fixed to it at or adjacent its free end having a configuration like that shown in FIG. 1.

As best shown in FIGS. 1, 2 and 4, each side restraint 38 and 40 preferably includes a cinching arrangement 168 that cooperates with an adjuster strap 170 and an anchor strap 172 to enable it to be tightened as needed to help three dimensionally conform it and its corresponding adjacent retainer flap 64 and 66 around books 22 in the sling 20. When each restraint 38 and 40 preferably is suitably tightened around the books 22 in the sling 20, the sling 20 and books 22 behave substantially as a single object, which advantageously prevents load shifting during transport thereby reducing user fatigue while also preventing books from inadvertently falling out during book sling loading, lifting, and transport.

Part of each side restraint 38 and 40, including the cinching arrangement 168, preferably is spaced from the adjacent side retainer flap 64 and 66 sufficiently so as to permit relative movement therebetween during tightening or loosening of each restraint 38 and 40. As a result of permitting such relative movement to occur, the book sling 20 advantageously can be capable of varying its book-carrying capacity greatly. For example, when fewer books 22 are in the book sling 20, relative movement between each restraint 38 and 40 and its corresponding retainer flap 64 and 66 permit the adjacent flap to fold, bend or otherwise deform to accommodate the smaller load volume when each restraint 38 and 40 is tightened.

As a result of being wider than the adjacent restraint supporting it, each retainer flap 64 and 66 can help to more evenly spread forces from the corresponding adjacent restraints 38 and 40 to the books 22 in the sling 20 over a greater surface area of the books 22 preventing the books 22 from being damaged by the restraints 38 and 40, no matter how hard each restraint 38 and 40 is tightened.

The anchor strap 172 of each side restraint 38 and 40 is preferably fixed at one end to the cinching arrangement 168 and at its other end to a generally triangular flexible mounting tab 174 that extends outwardly from one of the sling walls, preferably rear wall 32. The adjuster strap 170 is fixed at one end to the other one of the sling walls, preferably wall 28, and adjustably threaded through a strap adjuster 176 of the cinching arrangement 168.

As is shown in FIGS. 1 and 4, the fixed end of the adjuster strap 170 preferably directly overlies the flap connector strap 74 of the adjacent retainer flap 64 or 66. In a preferred embodiment, the adjuster strap 170 is attached directly to the flap connector strap 74 adjacent sling wall 28, such as in the manner depicted in FIG. 4. It preferably also is attached directly to sling wall 28. A portion of the adjuster strap 170 threaded through the cinching adjuster 176 preferably extends beyond the adjuster 176 defining a handle strap segment 178 that preferably also includes a grasp tab 180 at its free end. Such a construction advantageously can provide quick, easy and convenient cinching adjustment of each side restraint 38 and 40, even while the book sling 20 is being worn. The adjuster strap 170 also is preferably fixed to a sling wall, in this case 28, that enables it to be threaded through adjuster 176 in a manner ensuring the strap handle segment 178 that extends outwardly from the adjuster 176 extends generally toward the back of a user 30 wearing the book sling 20 so the user can reach back and grasp the handle segment 178 while wearing the sling 20 to perform a cinching adjustment to either side restraint 38 and 40.

The top restraint 42 also can include a cinching arrangement 182 that not only facilitates length and for tension adjustment but which also is of releasably latching construction for enabling the restraint 42 to be opened permitting unobstructed access to books 22 in the book sling 20. For example, when the restraint 42 is open, books 22 can be loaded into the sling 20 and/or books 22 can be removed from the sling 20.

The releasable latching cinch arrangement 182 preferably includes a strap adjuster 184 that is integrated with a buckle and socket type releasable latch assembly 186 that preferably is of side release cinch buckle construction or the like. An adjuster strap 188 (FIG. 1) is preferably fixed at or adjacent one end to one of the sling walls, preferably wall 28, and threaded through the strap adjuster 184 such that a handle strap segment 190 can extend outwardly from the adjuster 184 towards a person 30 wearing the book sling 20. The free end of the handle strap segment 190 preferably has a grasp tab 192 attached to it.

By this component arrangement causing the handle segment 190 to extend generally toward the back of a person 30 wearing the sling 20, it advantageously enables the handle segment 190 to be easily grasped and manipulated by the user 30 to cinch or un-cinch the top restraint 42. For example, handle segment 190 can easily be reached by a person 30 wearing the sling 20 to pull it to cinch the top restraint 42 tighter so the sling walls 28 and 32 more securely clamp against or otherwise engage books 22 in the sling 20.

The latch assembly 186 preferably includes a buckle 194 that is releasably interlocks with a buckle socket 196 when the tongue or tongues 202 (FIG. 2) of the buckle 194 are inserted into the socket 196. The buckle 194 preferably includes an integrally formed slide adjuster 198 disposed on its side opposite its socket engaging tongue or tongues 202 through which part of the adjuster strap 188 extends. An anchor strap 200 is preferably fixed at or adjacent one end to the other one of the sling walls, preferably wall 32, and is attached to the buckle socket 196 at or adjacent its other end. In the preferred embodiment shown in FIGS. 2 and 4, the part of the anchor strap 200 that attaches to sling wall 32 preferably includes a plurality of upraised loops 204 formed via attachment to the wall 32 with each loop 204 preferably configured to retain an article, such as a pen, pencil or the like (not shown).

Figure 5:
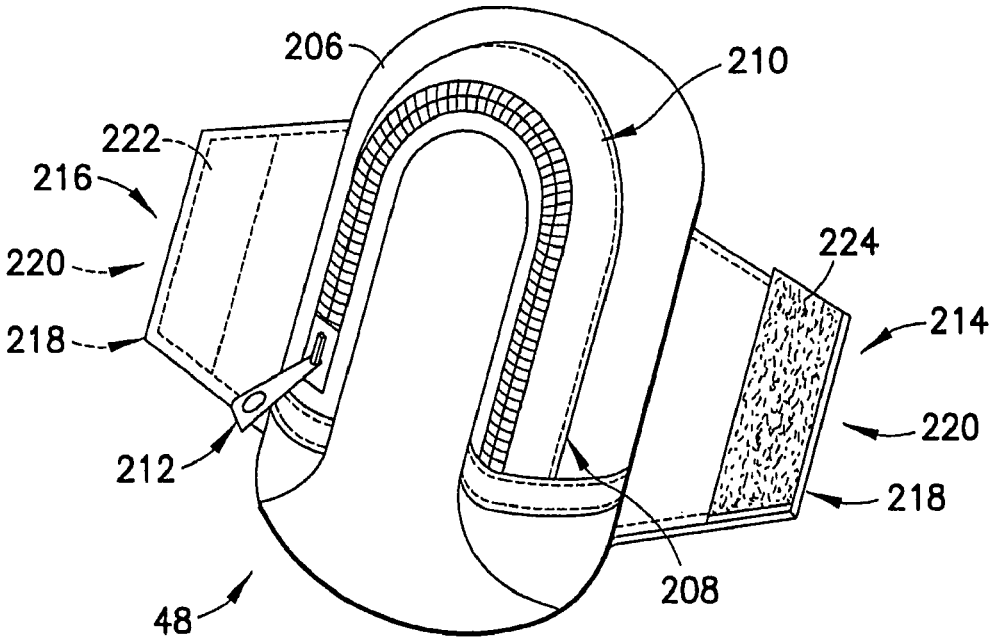
FIG. 5 is a perspective view of a removable, sling-strap carried reclosable pouch.
Figure 6:
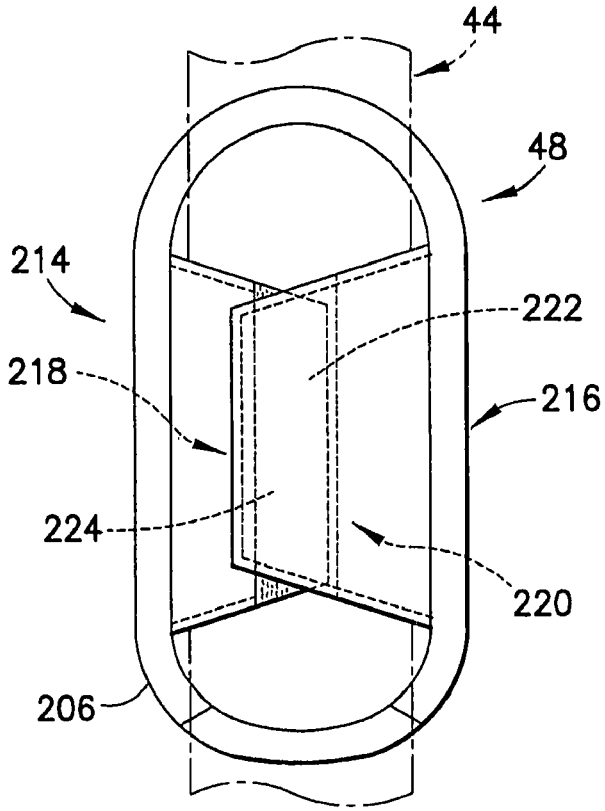
FIG. 6 is a rear plan view of the pouch depicted attached to a strap (in phantom) of the book sling.

With reference to FIGS. 5 and 6, the reclosable pouch 48 can be carried by the shoulder strap 44, such as is in the manner shown in FIG. 1. The pouch 48 shown in FIGS. 5 and 6 has an outer wall 206 defining an elongate and oblong, e.g. egg-shaped pouch construction having a generally U-shaped reclosable opening 208 that can be opened to insert a cell phone, a PDA, a data storage device, or a music player, preferably an MP3 player or the like into the pouch 48.

Likewise, the reclosable opening 208 can be opened to remove any such article being held inside the pouch 48. In the preferred embodiment shown in FIGS. 5 and 6, the reclosable opening 208 employs a reclosable fastening arrangement 210, such as preferably a zipper 212 or the like, to enable the pouch 48 to be selectively opened or closed.

The pouch 48 preferably can be adjustably positioned along the shoulder strap 44 such that it can be oriented to enable pouch access by a user 30 while carrying the book sling 20. To enable the pouch 48 to be completely removed from the strap 44, it may include a pair of outwardly extending mounting wings 214 and 216 that wrap around the strap 44 and engage one another to releasably mount the pouch 48 to the strap 44.

A releasably engaging fastening arrangement 218 that preferably is a hook and loop fastening arrangement 220, such as VELCRO, is used to releasably engage the wings 214 and 216 and keep them engaged with one another when wrapped around the strap 44. As is shown in FIG. 6, one of the wings 214 preferably has a hook containing fastener strip 222 attached to it and the other one of the wings 216 preferably has a loop containing fastener strip 224 attach to it. When the wings 214 and 216 are wrapped around the shoulder strap 44 enough so the fastener strips 222 and 224 come into contact, they releasably engage one another preventing disengagement without significant intentional manual effort being applied to pull the wings 214 and 216 apart. Preferably, this mounting arrangement advantageously not only allow the pouch 48 to be positioned just about anywhere along the shoulder strap 44, it also permits the pouch 48 to be removed and used independently from the book sling 20 as it can be transported independently of the sling 20.

Another preferred embodiment is shown by FIGS. 7 through 13. According to FIG. 7, a book sling 300 preferably includes a rear wall 314 and a front wall 316 spaced apart from the rear wall by a bottom 318 and two mesh side walls 319 on either side of the book sling 300.

The book sling 300 may be formed in accordance with any of the aspects described above. The book sling 300 may preferably be provided with a sling strap 317 rigidly attached to the top of front wall and a bottom corner of front wall to enable user to carry the bag over a shoulder to transport books.

Figure 7:
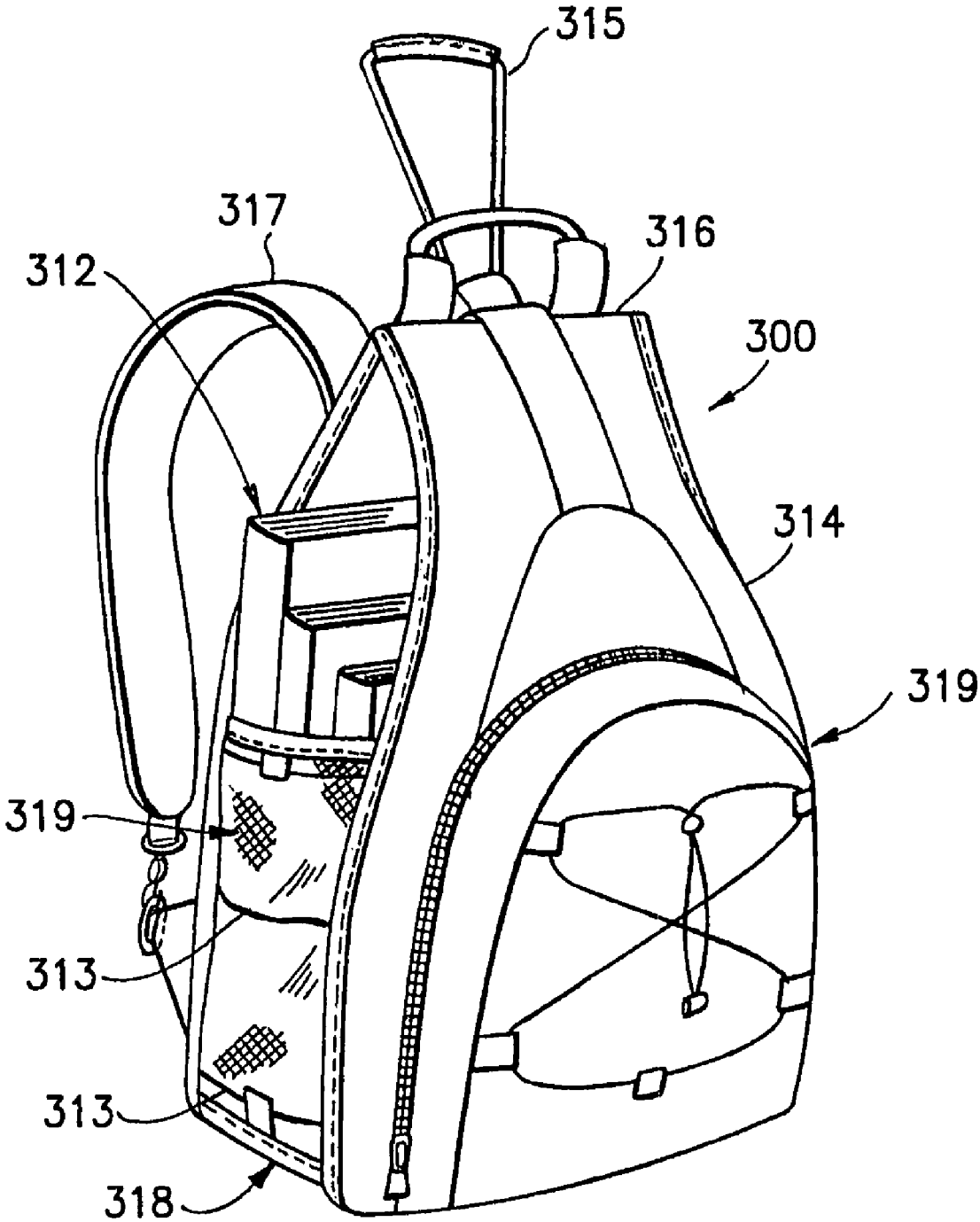
FIG. 7 is a perspective view of another embodiment of a book sling constructed in accordance with the present invention carrying a plurality of books depicting the book sling in a shoulder-carried or operational position.

Also seen in the preferred embodiment of FIG. 7 is the auto cinching handle 315 which, as will be further described hereinafter, preferably is attached to adjustable side restraints 313.

As will be further described hereinafter, when a user pulls on auto cinching handle 315, adjustable side restraints 313 are retracted, thereby moving rear wall 314 closer to front wall 316 and securely holding the contents within the book sling.

Figure 8:
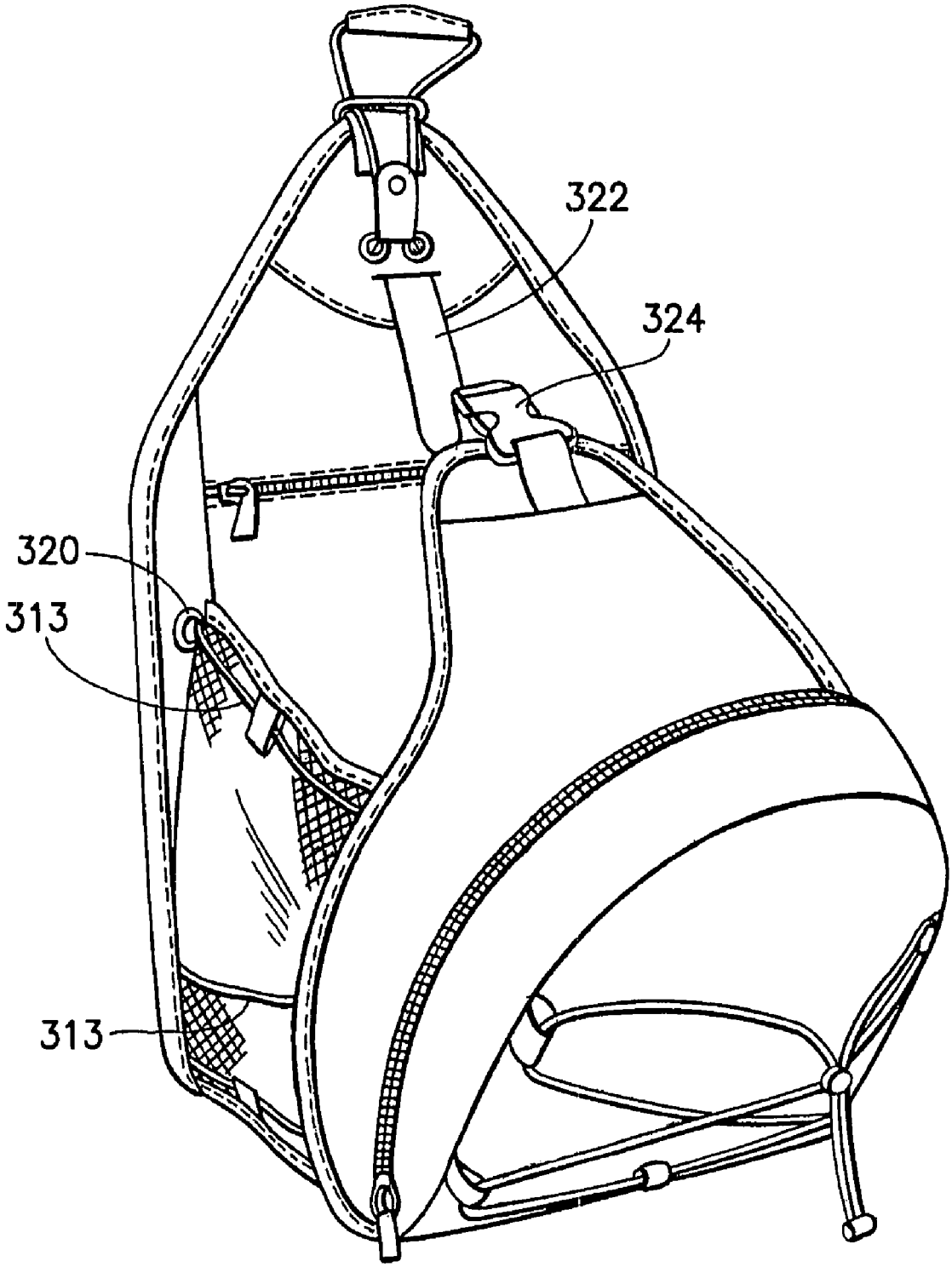
FIG. 8 is front perspective view of a book sling of FIG. 7 constructed in accordance with the present invention in an expanded position.

FIG. 8 is shown as a front, perspective view of the preferred embodiment of book sling according to the present invention, clearly showing side restraints 313 which can be securely affixed to rear wall 314 and pass through grommets 320 on front wall 316 into the interior of front wall where they are connected to auto cinching handle, as will be further described hereinafter. Also show in FIG. 8 preferably is an adjustable strap with a buckle 322 attached to the too of rear wall 314 and the inside top of front wall 316 for securely closing the top of book sling once objects are loaded into the interior space of book sling 300.

Strap 322 can have a releasable buckle 324 for releasably attaching strap 322 from the front wall to the rear wall to facilitate loading and unloading of the book sling. Furthermore strap 322 preferably is adjustable such that it can be lengthened or shortened to conform to the size load that preferably is contained within the book sling.

Figure 9:
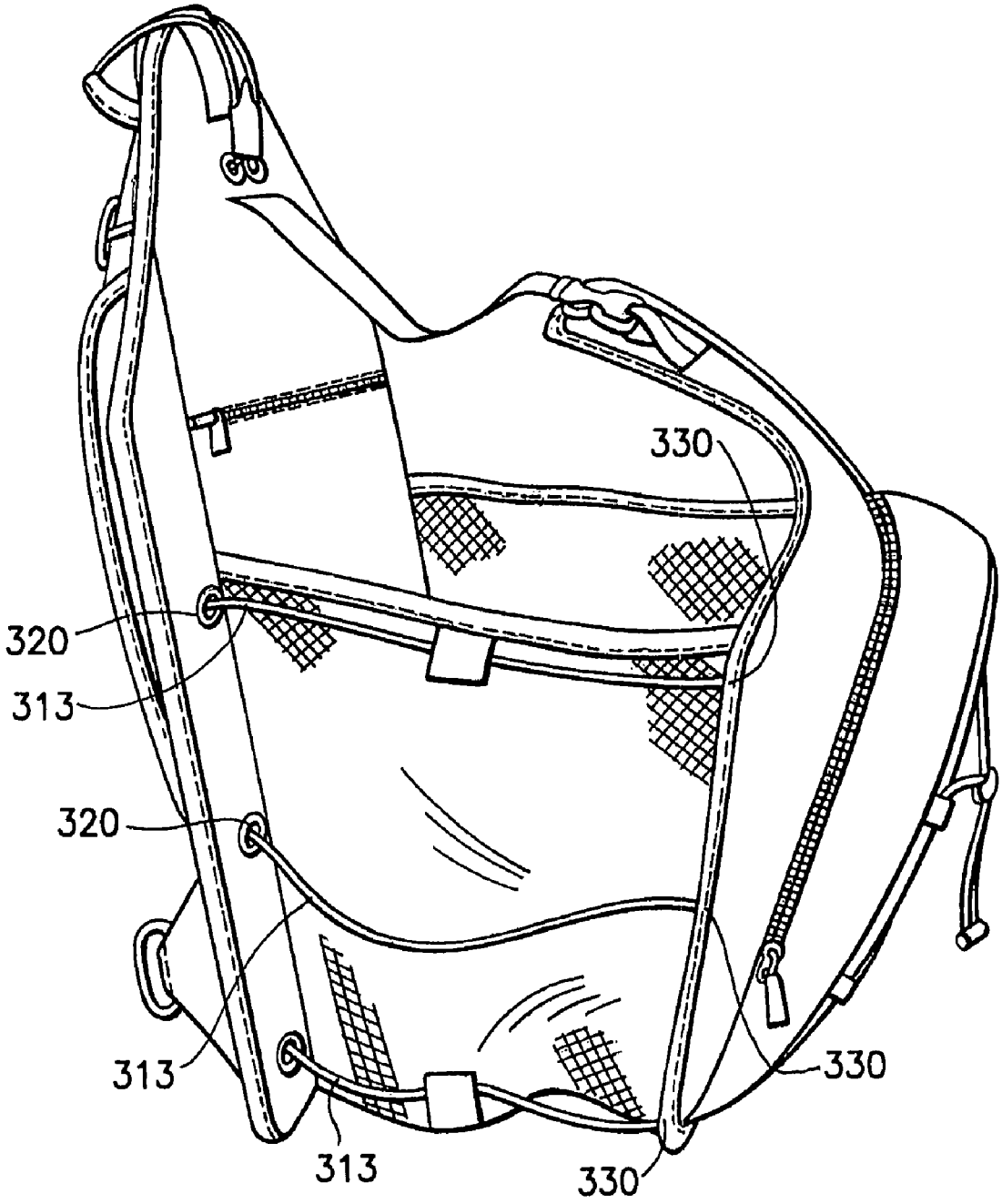
FIG. 9 is a side perspective view of a book sling of FIG. 7 constructed in accordance with the present invention in an expanded position.

FIG. 9 is a side perspective view of the preferred embodiment of book sling whereby restraints 313 are visible, extending from rear wall 314 to front wall 316 through grommets 320. The adjustable side restraints are preferably securely affixed to front wall 316 at points of varying heights 330 along rear wall 314. In this way, the adjustable side restraints can pull equally from front wall to back wall at varying heights in order to provide a secure and uniform tightening effect for any size or shape load carried within the book sling.

Figure 10:
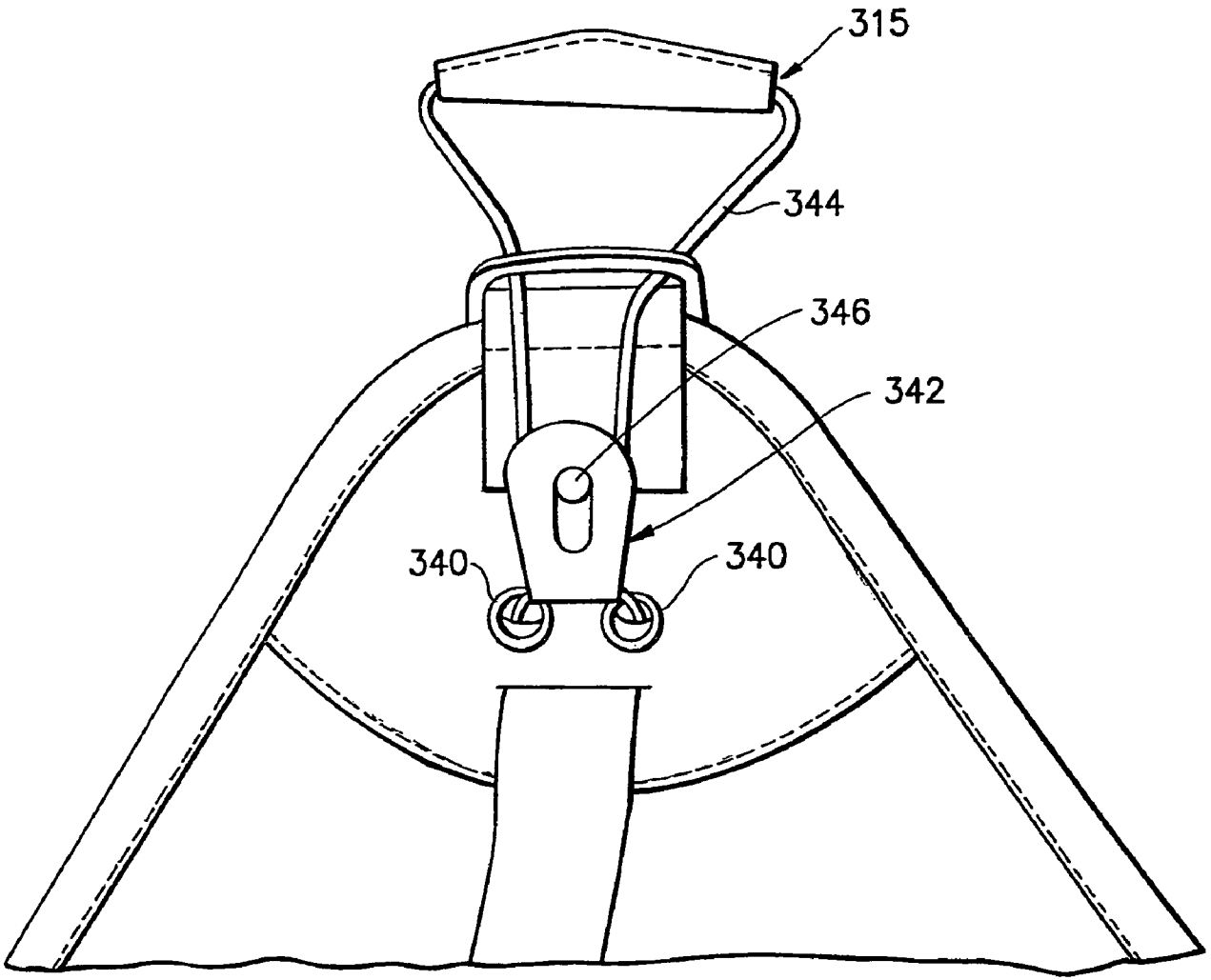
FIG. 10 is a front view of the auto cinch handle of a book sling of FIG. 7 constructed in accordance with the present invention.

FIG. 10 is a front view of the auto cinch handle of a book sling showing a view of the top of front wall 316 with the auto cinch handle 315 preferably extending beyond the top of front wall 316 and entering into the interior of front wall 316 through grommets 340. In addition, there preferably is provided and depicted in FIG. 4 a locking mechanism 342 for releasably securing auto cinch handle in a tightened position once a user fully tightens adjustable restraints 313 by pulling on handle 315. The cord 344 of auto cinching handle 315 preferably passes through the locking mechanism 342 before entering the interior of front wall 316. When the handle preferably is pulled into a tightened position, the locking mechanism prevents the cord from reversing its direction and thereby loosening adjustable restraints 313. Locking mechanism 342 preferably is released by pressing button 346 in a downward direction as depicted, thereby releasing the locking mechanism and allowing cord 344 to pass through the locking mechanism, thereby allowing adjustable restraints 313 to be loosened up and expanding book sling 300.

Figure 11:
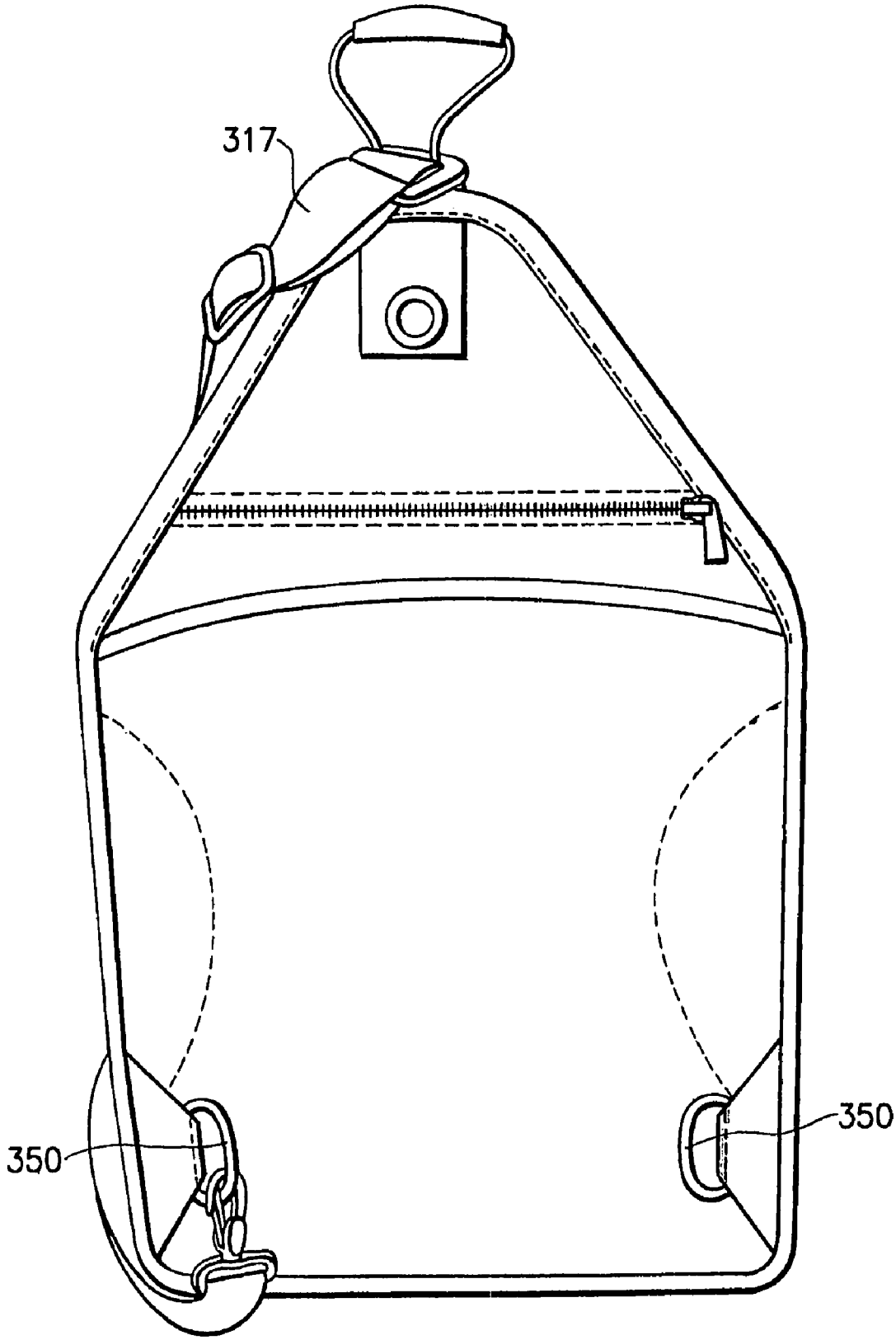
FIG. 11 is a view of the back of the book sling of FIG. 7 constructed in accordance with the present invention.

FIG. 11 preferably shows a front view of front wall 316 showing cushioned material placed on the outside of front wall thereby providing a soft surface for a user that would carry the book sling across a shoulder and leaning against the user's back. Also visible is shoulder strap 317 preferably attached to the top of front wall 316 and also to D-ring 350 at the left front, as depicted, bottom of front wall 316. It should be noted that an additional D-ring 350 appears on the right bottom corner of front wall 316. Similar to the above embodiment, a user can switch strap 317 from the right to the left-hand side, thereby facilitating carrying it on a right or left shoulder, in accordance with the user's preferences.

As further depicted, there preferably is both a zippered pocket as well as a pouch on the front of front wall 316 although the configuration depicted preferably is only representative of one particular embodiment and front pocket and/or pouches maybe included on the front wall in any number of configurations.

Figure 12:
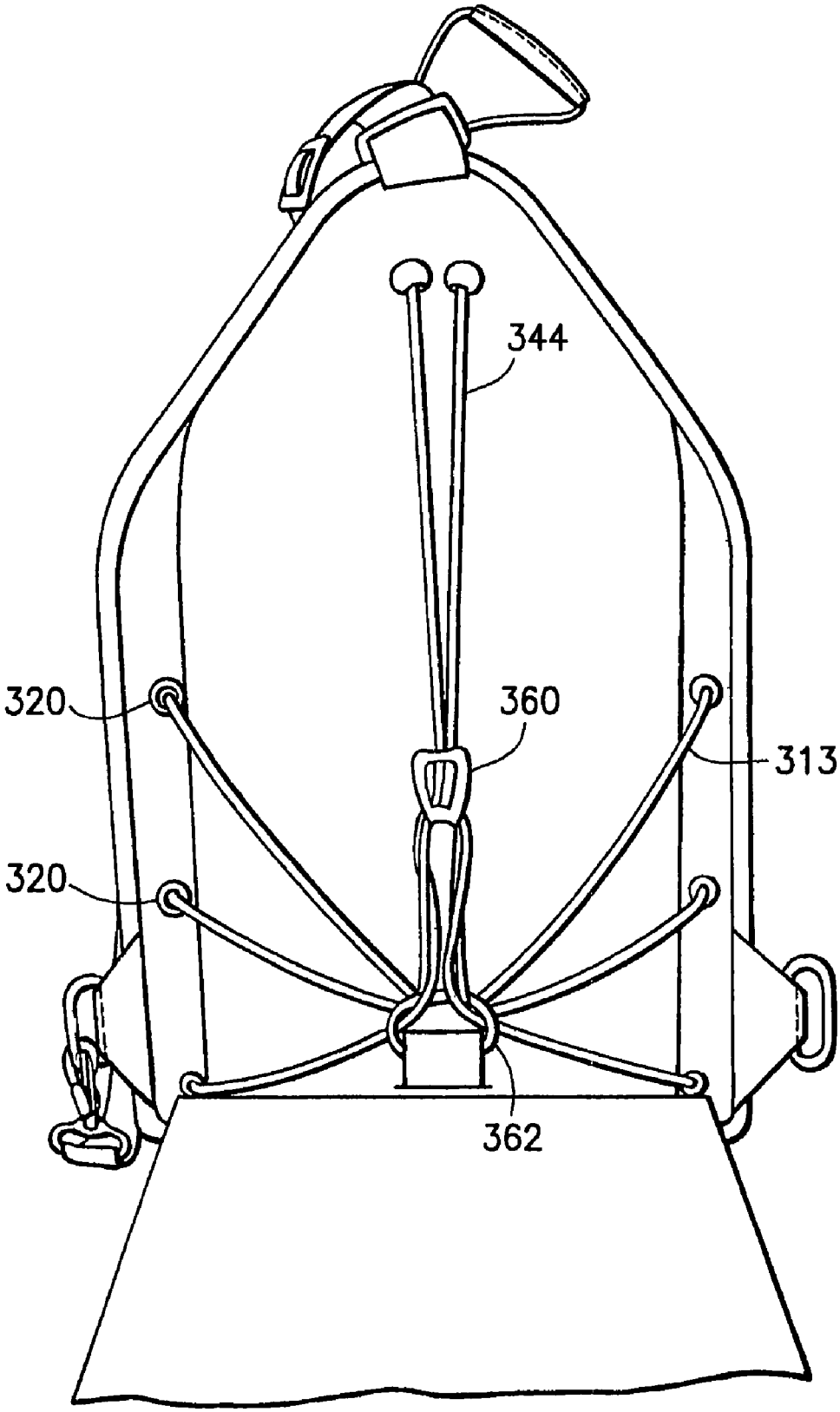
FIG. 12 is a cut-away view of the auto cinching mechanism of a book sling of FIG. 7 constructed in accordance with the present invention.

FIG. 12 preferably is showing an interior cut-away view of the preferred embodiment of the auto cinching mechanism for the book sling in accordance with the present invention. There preferably is shown cord 344 extending from handle 315 which, as previously described, passes through grommets 340 on the front of front wall 316 and into the interior portion of front wall 316, as shown. Cord 344 may extend downward along the back of front wall 316 and preferably is attached by way of a loop 360 through which adjustable restraints 313 pass. The loop permits the free movement of adjustable restraints 313 through the loop such that when auto cinching handle preferably is pulled and thereby shortened, the adjustable restraints can pass through the loop freely. In addition, as previously described, adjustable restraints 313 can pass through grommets 320 in front wall 316 which are visible on the interior cut-away portion of front wall 316. Adjustable restraints 313 can pass through the grommets and extending through a D-ring which preferably is affixed to the bottom of the interior portion of front wall 316, then, continuously extend through the D-ring and loop 360 and preferably further extend back out through the opposite side of front wall 316, through grommets 320. In this way, it can be seen that the adjustable restraints 313 can be each, one continuous cord which preferably is securely affixed to one side of rear wall 314 extending through grommets 320, and through D-ring 362, and loop 360, and extending back out of the opposite side of front wall 316 through grommets 320 and are securely affixed to the opposite side of front wall. In this way, it can be seen that by pulling on auto cinching handle 315 and shortening cord 344, adjustable restraints 313 can also be thereby pulled upwards by loop 360, and thus decrease the distance between front wall 314 and front wall 316 to decrease the space within U-shaped sling 310 to securely carry the load therein. Both adjustable restrains 313 and cord 344 can be formed from non-elastic cords, such as nylon of varying diameter. The cords shown can be approximately 4 mm in diameter. However, as stated, they may be of varying diameter and/or composition as needed in accordance with the anticipated use and load bearing capabilities.

Figure 13:
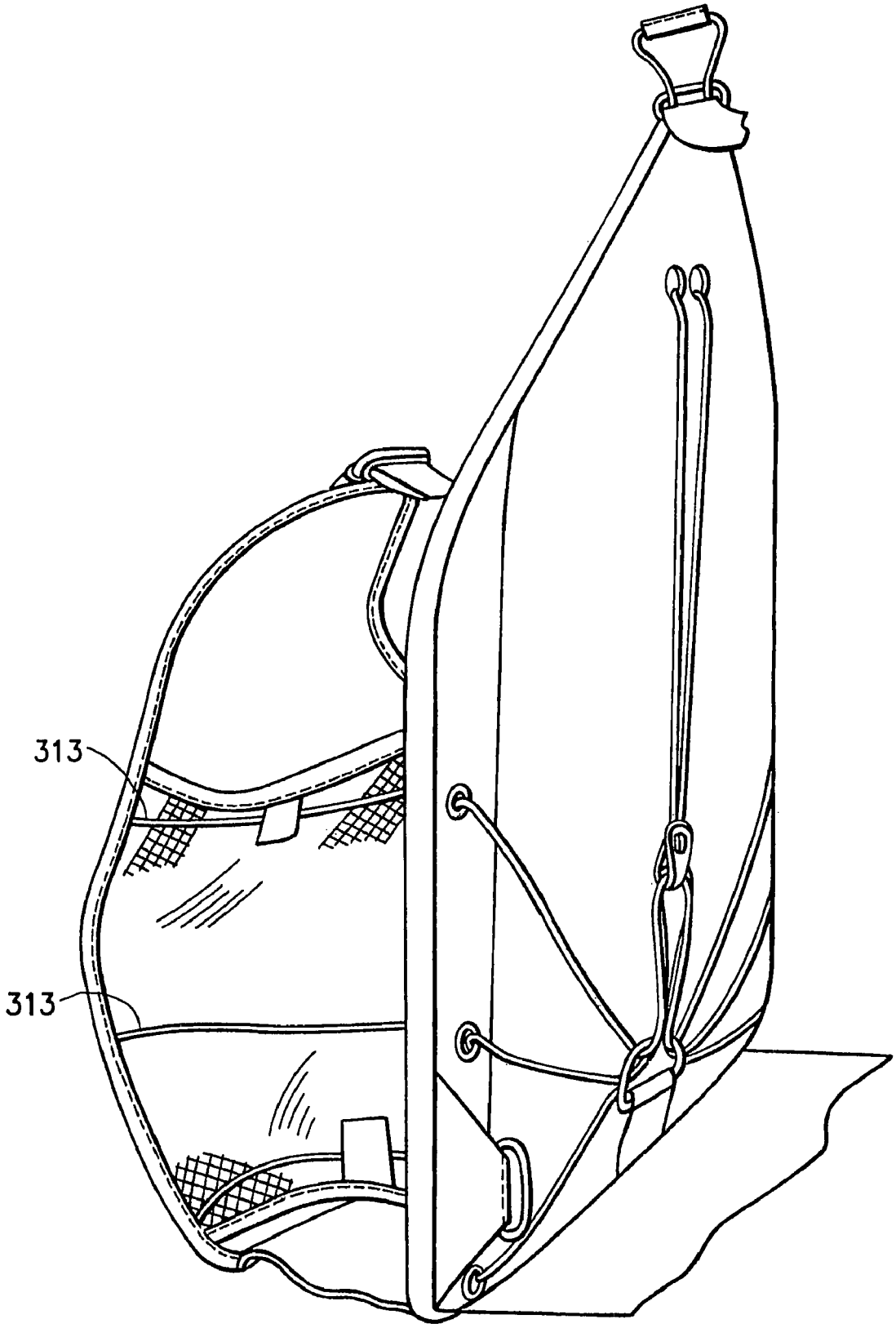
FIG. 13 is a side cut-away view of the auto cinching mechanism of a book sling of FIG. 7 constructed in accordance with the present invention.

FIG. 13 preferably is shown as a side cut-away view of the book sling in accordance with the present invention depicting adjustable restraints 313 extending from front wall wherein they are securely affixed at various points along front wall as previously described, extending through grommets 320 of back wall, and then further continuously through D-ring 362 and loop 360, then returning through D-ring 362 and out to the opposite side of front wall 316.

Figure 14:
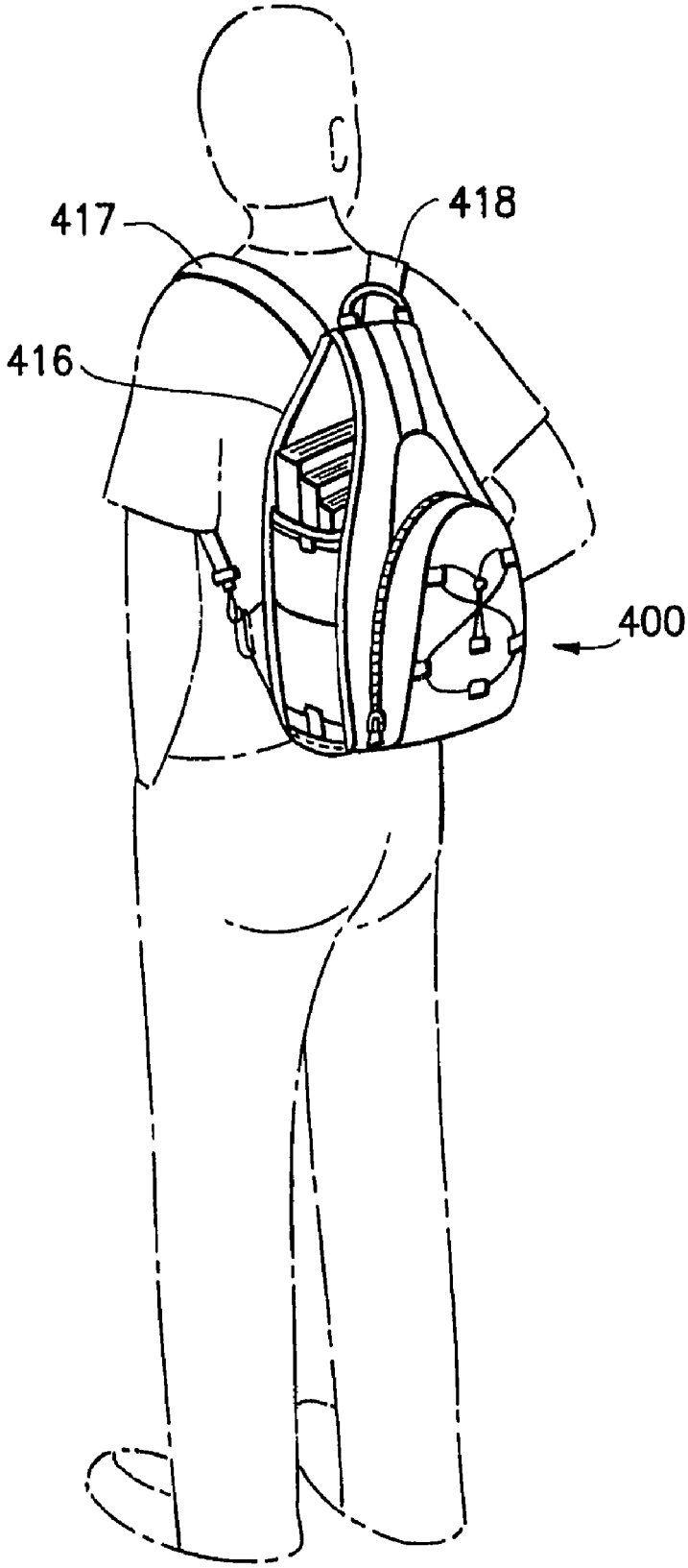
FIG. 14 is yet another preferred embodiment of a book bag constructed in accordance with the present invention with a person wearing the book bag as a backpack over his shoulder in an operational position.

The book slings described above may be provided with more than one shoulder strap, e.g., to provide a back pack configuration. With reference to FIG. 14, a book sling or backpack 400 with a person wearing it over his shoulders in an operational position is shown. Two shoulder straps 417 and 418 are preferably connected adjacent to the top part as well as the bottom part of the front wall 416 facing the user.

In addition, the book sling 20 and/or 300 of the present invention can be adapted to incorporate various features from commonly owned, commonly invented, U.S. application Ser. No. 11/700,453, filed Jan. 31, 2007, titled Cinching Shoulder or Back Carried Bag and Method, the entirety of which is hereby incorporated by reference herein. For example, the book sling 20 and/or 300 of the present invention can be adapted to incorporate other features disclosed in the '453 application and/or which are identified in the '453 application drawings. It may be desired to modify the side restraints 38 and 40 of the book sling 20 and/or 300 of the present invention to incorporate corresponding features of the shoulder back carried bag disclosed in the '453 application. For example, it may be desired to remove or otherwise further restricting the length adjustability of the side restraints 38 and 40 where the automatic cinching arrangement disclosed in the '453 application is employed in the book sling 20 and/or 300 of the present invention.

Various alternatives are contemplated as being within the scope of the one or more inventions disclosed herein. Therefore, it is to be understood that, although the foregoing description and drawings describe and illustrate in detail one or more preferred embodiments of the present invention, to those skilled in the art to which the present invention relates, the present disclosure will suggest many modifications and constructions as well as widely differing embodiments and applications without thereby departing from the spirit and scope of each such invention including any and all such inventions claimed herein. Accordingly, the particularly disclosed scope of the invention is set forth in the following claims.

What is claimed is:

1. A book sling for receiving and retaining objects comprising a generally U-shaped cradle formed of first and second side walls and a flexible resilient bottom disposed between said side walls further including an auto-cinching mechanism for decreasing the distance between said first and second side wall a variable length in response to the dimension of said objects comprising a plurality of cords each having a first terminal end affixed to a first edge of said first side wall and passing through apertures in said second side wall and having a second terminal end affixed to a second edge of said first side wall, wherein said plurality of cords are gathered within a loop that can slide along said plurality of cords for retracting said plurality of cords and wherein said loop is attached to a handle for pulling said plurality of cords when extended.

2. The book sling of claim 1, further comprising: at least one mesh wall extending between said first and second side walls.

3. The book sling of claim 1, wherein said first and second side walls each include side edges, said side edges being spaced apart above said bottom.

4. The handle according to claim 1, wherein said handle further includes a locking mechanism for maintaining said handle in an extended position.

5. The book sling of claim 1, further comprising: at least one shoulder strap connected to said side wall adjacent a top part of said first side wall and adjacent a bottom part of said first side wall.

6. The book sling of claim 5, wherein two shoulder straps are connected to said first side wall adjacent a top part of said first side wall and adjacent a bottom part of said first side wall.

7. The book sling of claim 1, further comprising: a top restraint that extends adjacent or along a top of said first side wall to adjacent or along a top of said second side wall, said top restraint at least partially overlying said cradle.

8. The book sling of claim 7, wherein said top restraint includes a strap that cooperates with an adjuster and latch assembly having an adjuster constructed and arranged to permit adjustment of restraint length between said first and second sidewalls and a latch permitting said restraint to be disengaged enabling unobstructed access to said cradle from a top of the book sling.

9. The book sling of claim 8, further comprising: a shoulder strap that is connected to one of said first and second side walls such that said shoulder strap is operatively connected to said top restraint strap.

10. The book sling of claim 9, wherein said shoulder strap and said top restraint strap include a common strap with said common strap defining an end of said top restraint strap and also defining an end of said shoulder strap.

11. The book sling of claim 7, wherein at least said first side wall further comprises: a top flap along the top of said first side wall that extends generally toward said second side wall, wherein said top flap underlies said top restraint.

* * * * *